United States Patent [19]

Novotny et al.

[11] Patent Number: 5,020,734

[45] Date of Patent: Jun. 4, 1991

[54] PULVERIZER HAVING ROTATABLE TABLE WITH REPLACEABLE AIR PORT SEGMENTS

[75] Inventors: Randall J. Novotny, Morris; Ralph L. Cummins, High Bridge, both of N.J.

[73] Assignee: Foster Wheeler Energy Corporation, Clinton, N.J.

[21] Appl. No.: 511,926

[22] Filed: Apr. 16, 1990

Related U.S. Application Data

[63] Continuation of Ser. No. 382,374, Jul. 20, 1989, abandoned.

[51] Int. Cl.[5] ..... B02C 15/00

[52] U.S. Cl. ..... 241/119

[58] Field of Search ..... 241/117-121, 241/79.1, 80

[56] References Cited

U.S. PATENT DOCUMENTS 4,721,258 1/1988 Dougan et al. ..... 241/119 X

FOREIGN PATENT DOCUMENTS 1269832 11/1986 U.S.S.R. ..... 241/121

OTHER PUBLICATIONS

Aufbereitungs-Technik, 12-71 .

*Primary Examiner*—Mark Rosenbaum

*Attorney, Agent, or Firm*—Marvin A. Naigur

[57] ABSTRACT

A pulverizer for particulate material such as coal includes a housing having a centrally located feed chute, and enclosing a rotary grinding table having an air port unit formed as multiple segments removable attached to the rotary table outer periphery and containing air flow passageways. Located adjacent the air port unit is an outer segmented ring attached rigidly to the pulverizer housing, with a radial gap being provided between the outer ring and the air port unit ring segments. The outer ring segments include upper wear plugs removably attached onto the outer ring lower segments. Whenever the upper parts of the air port unit segments become worn excessively due to erosion, or there is a need to change air flow requirements of the pulverizer, the rotatable air port segmented ring upper parts only are conveniently replaced along with the upper wear segments of the adjacent outer stationary ring.

8 Claims, 3 Drawing Sheets

PULVERIZER HAVING ROTATABLE TABLE WITH REPLACEABLE AIR PORT SEGMENTS

This application is a continuation, of application Ser. No. 382,374, filed July 20, 1989, now abandoned.

This invention pertains to pulverizers of the roll and race type which have a rotatable grinding table containing air port flow passages. It pertains particularly to such pulverizers for coal having a grinding table with multiple replaceable air port segments provided at the table periphery adjacent an outer segmented ring.

Pulverizers for coal having a centrally located coal feed conduit and a rotary grinding table and rolls provided in the pulverizer lower portion for pulverizing coal and pneumatically conveying it upwardly to boilers for combustion therein are well known. For example, such pulverizers for coal are disclosed by U.S. Pat. No. 4,264,041 to Kitto, Jr. et al and U.S. Pat. No. 4,687,145 to Dougan et al. In these pulverizers, the carrier air passes upwardly from a plenum through air ports containing a plurality of vanes and entrains pulverized coal upwardly from the outer edge of the rotatable grinding ring. However, problems have been experienced with excessive wear in the pulverizer rotatable grinding table outer air port region near the pulverizer housing wall, requiring frequent replacement of large and expensive grinding table parts. Such excessive wear has occurred in the area between the rotating grinding table and the stationary airport parts, which has required frequent replacement of the airports. Also, the prior stationary air port designs promoted areas of excessive wear on the pulverizer housing and other internal components. Such wear problems due to erosion by the coal in the grinding table air port region of the pulverizer have now been advantageously overcome by the present invention.

SUMMARY OF INVENTION

This invention provides an improved pulverizer contain a rotatable grinding table having an improved air port configuration, for passing primary air to pulverized materi and pneumatically conveying the material such as coal upwar to a boiler for combustion therein. The air port unit is a rigidly to the grinding table outer periphery, and includes multiple removable ring segments. Each ring segment of the port unit consists of a lower part and an upper part, with part being removably attached to the outer periphery of the grinding table. The ring segments each have upwardly orient air flow passa ways provided therein, which are each angled radially inwar by an angle of 10°-20° relative to a vertical plane. The flow passages are also each angled forwardly relative to the grinding table direction of rotation at an angle of 40°-60° and preferably at about 45° angle with the horizontal plane. The use of a 60° forward angle as compared to a smaller angle of about 30° results in less direct impingement of the entrained coal stream against the pulverizer housing, which reduces housing erosion.

Also, a stationary outer segmented ring is rigidly attached to the pulverizer housing wall inner side, with a radial of 0.100–0.190 inches and preferably about 0.125 inches being provided between the outer ring wall and the air port rotatable inner ring segments. The outer ring includes multiple segments with each segment having a lower part rigidly attached to the housing wall such as by welding, and an upper part removably attached to the outer ring segment lower part such as by bolting. By utilizing this improved air throat configuration, whenever excessive wear occurs to the air port segment upper parts and to the upper parts of the outer ring segments, these upper parts can be conveniently removed and replaced without requiring replacement of the segmented lower parts, which are larger and more expensive. Also, use of the separate segment upper parts allow these parts to be easily adjusted to maintain the desired 0.100–0.190 inch radial gap between the air port rotating and stationary parts.

The use of air port ring multiple segments having replaceable lower and upper parts according to the invention provides an improved means for matching of the pulverized air port air flow requirements to a particular pulverizer installation. Specifically, this configuration permits the air port lower segments to be sized to accommodate the largest volumetric air flow for a given pulverizer housing size, and also permits the segments upper parts to be sized to provide a desired smaller air flow rate as required to attain the proper air velocity for upward coal transport desired for the particular pulverizer installation. As a result, if the coal properties change, only the upper parts of the air port segments would need to be replaced to maintain optimum coal transport air velocity, rather than replacing the entire air port assembly. Thus, the air port ring segment upper parts openings have flow passages which have between about 50–100% of the cross-sectional area of the ring segment lower parts.

This invention advantageously provides a pulverizer having an air port unit for which the ring segments upper parts, which receive the most erosion wear, can be replaced easily and economically without requiring replacement of the entire air port assembly. The air port configuration also advantageously provides for changes in air flow requirements as needed to meet changes in pulverizer operations.

BRIEF DESCRIPTION OF DRAWINGS

The invention will be described with reference to the following drawings, in which.

DESCRIPTION OF INVENTION

Figure 1:
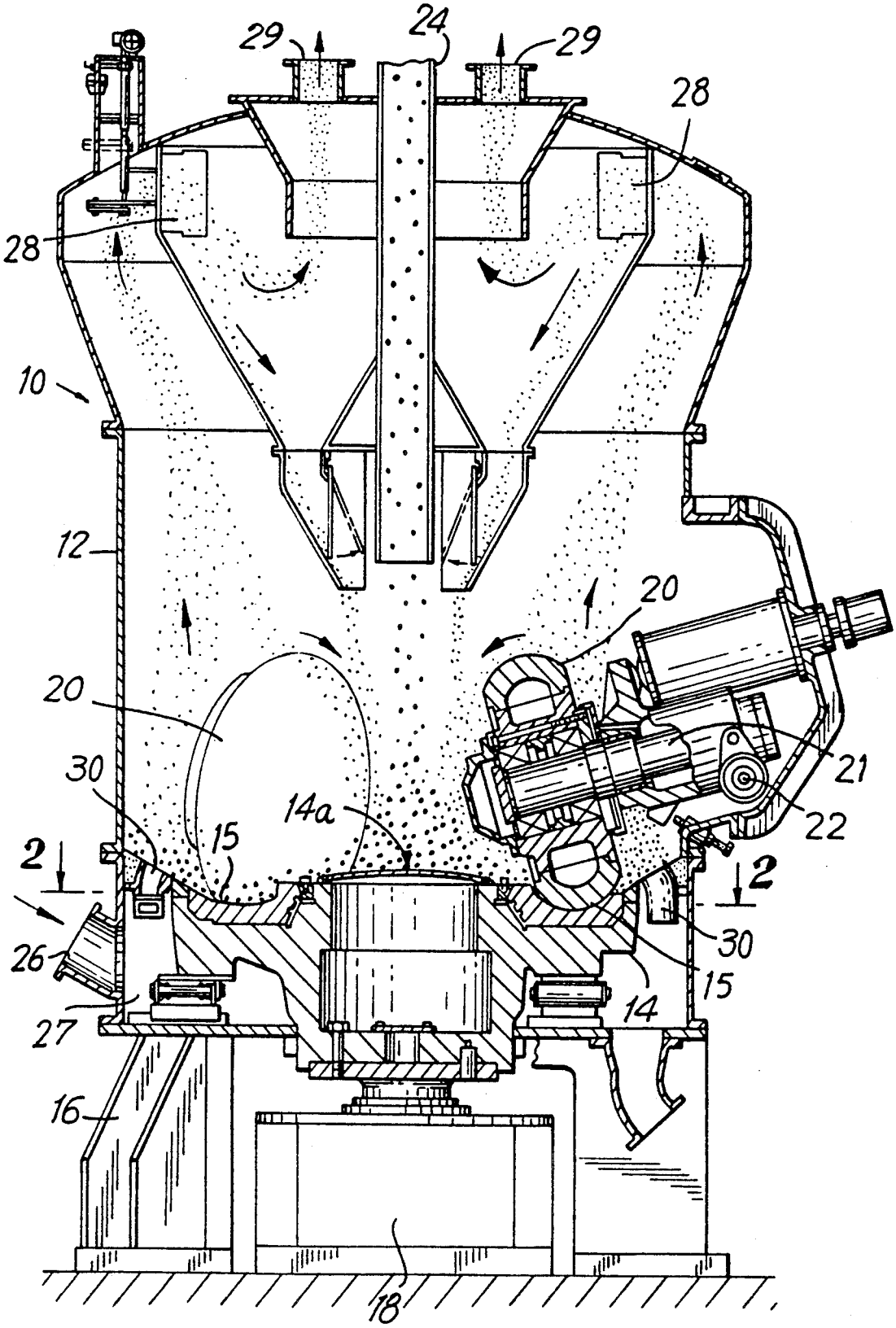
FIG. 1 shows an elevational sectional view of a coal pulverizer, including a rotary grinding table provided in the pulverizer housing lower portion.

As is generally shown in FIG. 1, a coal pulverizer assembly 10 includes an outer casing 12 which encloses a rotary grinding table 14. The grinding table 14 is usually supported and rotated by a pulverizer gear reducer and drive motor unit 18 located within the base 16.

Triple equally spaced rollers 20 are each pivotably attached to the housing 12 above the rotary grinding table 14. Rollers 20 can each rotate about their own shafts 21, which are pivotably attached at 22 to housing 12, so that the rollers 20 are each rotated in race 15 and on the coal therein by the rotation of the grinding table 14. The coal feed enters the pulverizer 10 via a central feed chute unit 24 and falls onto a central portion **14*a* of the rotatable grinding table 14. The three rotatable grinding roller units 20, which each rest on the grinding table race 15 and the coal therein, progressively crushes the coal particles as they are passed radially outwardly across the grinding table 14 towards a plurality of air ports 30 attached to the periphery of the table 14. Air provided from inlet duct 26 and plenum 27 flows uniformly upwardly through the air ports 30 to carry the pulverized coal particles upwardly to the pulverizer classifier vanes 28 and upper exits 29** to a combustion zone (not shown).

Figure 2:
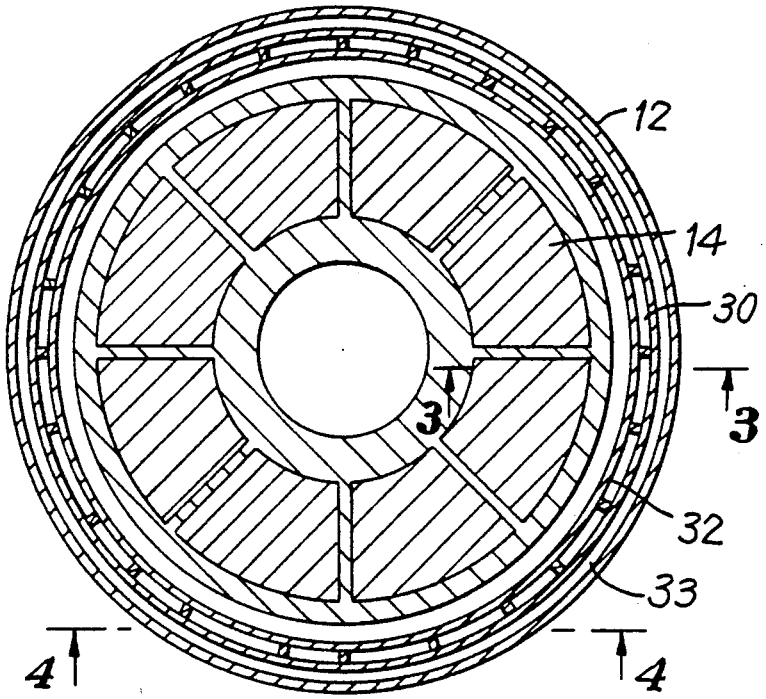
FIG. 2 is a sectional plan view taken at line 2—2 of FIG. 1 and shows a plan view of the rotary grinding table.
Figure 3:
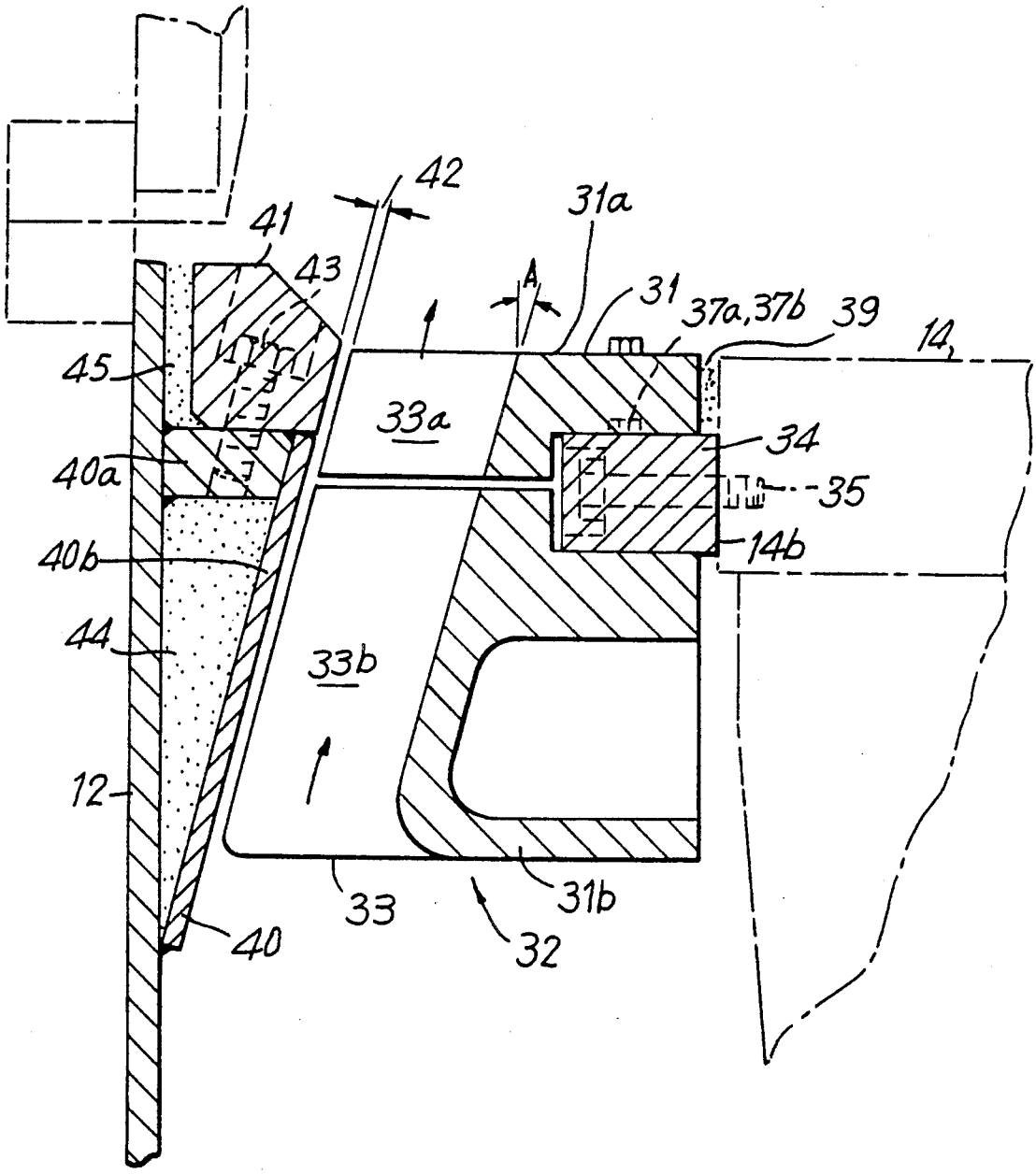
FIG. 3 shows a vertical sectional view taken at line 3—3 of FIG. 2.

A plan view of the pulverizer rotatable grinding table 14 and multiple air ports 30 is shown by FIG. 2. It is seen that the multiple peripheral air ports 30 are provided by a segmented ring 32, which is rigidly attached to the periphery of the grinding table 14. The multiple air ports 30 are provided circumferentially spaced apart in the segmented ring 32, which is removably attached to the periphery of grinding table 14 such as by bolting. The segmented ring 32 contains multiple segments 31, with at least 8 arcuate segments and usually not exceeding 20 segments being provided. As shown in greater detail by FIG. 3, the multiple segments 31 of ring 32 are rigidly attached onto the outer periphery 14*b* of pulverizer grinding table 14. Each ring segment 31 consists of an upper piece 31*a* and a lower piece 31*b*. A multi-piece segmented retainer ring 34 is bolted to the periphery 14*b* of the grinding table 14 by bolts 35. Both the upper piece 31*a* and the lower piece 31*b* are bolted to the segmented retainer ring 34 using a staggered bolting arrangement of bolts 37*a* and 37*b*. A plurality of upwardly oriented passageways 33 are provided through the ring segments 31, with the passageway walls being oriented radially inwardly by an angle A of 10°-20 relative to a vertical plane, and preferably at an angle of about 15°. If desired, a refractory cement material 39 can be provided in any gap between upper part 31*a* and the rotatable table 14.

An outer stationary ring 40 has a plurality of segments rigidly attached to the pulverizer housing 12 such as by welding, so as to provide a radial gap 42 between the outer ring 40 and the air port segmented ring 32. The radial gap 42 should be 0.100-0.190 inches wide and is preferably about 0.125 inches wide. A plurality of upper wear segments 41 are removably attached by bolts 43 onto the upper surface of the outer ring segments 40. The outer ring segments 40 consist of a vertically oriented plate 40*b* and cover 40*a*, which are both welded together and also welded to the pulverizer housing wall 12. The segmented upper parts 41 are bolted onto the lower part cover 40*a* by at least three spaced apart bolts 43 per segment. The upper parts 41 each have an upper surface which slopes radially outwardly and upwardly from the upper end of radial gap 42, so as to provide minimal interference with the coal particles passing upwardly through the passageways 33. The, outer stationary ring 40 includes at least 8 segments and usually not exceeding 20 segments. If desired, a refractory cement material 44 may be provided between the cover 40*a* and vertical plate 40*b* and housing 12. Also, a refractory cement material 45 may be provided between upper wear segments 41 and the housing 12.

Figure 4:
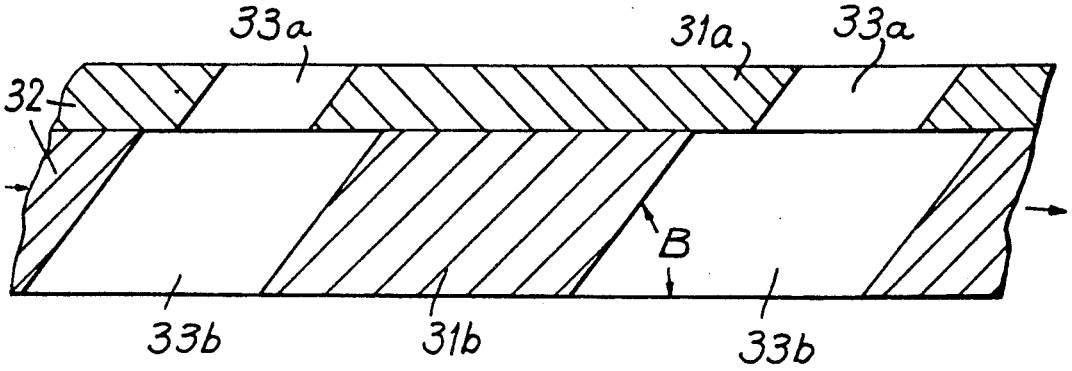
FIG. 4 shows a vertical sectional view taken at line 4—4 of FIG. 2 and shows the air port flow passages.

The orientation and size of the air port flow passages 33 in ring 32 is further shown by FIG. 4. The flow passages 33 are all angled forwardly, i.e. in the direction of rotation of the grinding ring 14, by an angle B of 40°-60° relative to a horizontal plane, and preferably by about 45° angle. The passages 33*b* in the segmented ring lower pieces 31*b* are sized to accommodate the largest volumetric flow for a particular pulverizer 10 frame size. The passages 33*a* in the ring upper pieces 31*a* are sized to provide the proper air velocity for particulate coal transport based on the actual volumetric flow required for a particular pulverizer installation. As a result, the opening area in the upper pieces 31*a* are always equivalent to or smaller than the opening area in lower pieces 31*b*. It has been found that the total cross-sectional area of the flow passages 33*a* in the upper pieces 31*a* should be made 50-100% of the cross-sectional area of the flow passages 33*b* in lower pieces 31*b*. Thus, portions of the upper pieces 31*a* may overlap portions of the flow passageways in the lower pieces 31*b*, as is shown by FIG. 4. By this arrangement, if fuel properties change and as a result the required volumetric air flow through the pulverizer also changes, the upper piece 31*a* can be conveniently replaced so as to provide a different flow cross-sectional area and thereby maintain optimum coal transport air velocity, rather than replacing the entire air port assembly.

As the air port ring upper surfaces wear away due to erosion by the coal being pulverized, only the top pieces or plugs 31*a* and outer upper wear segments 41 need to be replaced. With the prior art designs, the entire air port casting needed to be replaced, even though the erosion wear occurs only on the top surface of the ring. But for the present invention, pulverizer maintenance costs are thereby appreciably decreased because only the top wearing parts need to be replaced. Because the air port ring 32 is rotated with the grinding table 14, the air port housing wear is evened out circumferentially and not confined to a few locations. Housing wear is further decreased by the use of a larger forward angle B of inclination for the flow passages 33 of 40°-60° and preferably about 45°, rather than a previously utilized 30° angle of inclination. Use of a two piece design for air port ring segments 31 also allows replacement of only the top pieces 31*a* of segmented ring 32 to maintain proper coal transport velocities in the event of a change in fuel properties. But with the prior art designs, the entire air port casting would need to be replaced in order to provide revised flow area for passageways 33 so as to maintain proper upward transport velocities for the crushed coal particles.

This invention will be further described with the aid of the following Example, which should not be construed as limiting the scope of the invention.

EXAMPLE

A pulverizer for coal having a configuration generally as shown in FIG. 1 was constructed having a segmented air port configuration. The air port included a segmented inner ring bolted onto the periphery of the grinding table and having a plurality of air passageways which are angled both inwardly and forwardly. The segmented inner ring included upper and lower parts each separately bolted onto a segmented retainer ring, which is bolted onto the periphery of the grinding table. The air port also included a segmented outer ring, which had lower parts welded onto the pulverizer housing wall and upper parts bolted onto the lower parts. The air port segments had the following characteristics:

| | |
|---|---|
| Grinding table outer diameter, in. | 120 |
| Number of inner ring segments | 15 |
| Number of outer ring segments | 12 |

-continued

| | |
|---|---|
| Radial gap between inner and outer rings, in. | 0.125 |
| Radial width of flow passages, in. | 4 |
| Radial inward angle of flow passages, deg. | 15 |
| Forward angle of flow passage, deg. | 45 |
| Number of ports | 30 |

Whenever after extended service handling pulverized coal the upper parts of the air port ring segments become considerably worn, the upper parts only are removed from the grinding table inner ring and from the non-rotatable outer ring and are replaced with new parts.

Although this invention has been described broadly and in terms of a specific embodiment, it will be understood that modifications and variations can be made within the scope of the invention which is defined by the following claims.

We claim:

1. A pulverizer assembly for pulverizing particulate materials, including a housing, a grinding table rotatably mounted in the housing and having annular air port openings provided between the grinding table and the housing, and roller means contacting the grinding table upper surface for pulverizing the particulate material thereon, wherein the improvement comprises:

(a) an outer segmented ring attached to the housing wall at a location opposite the grinding table, said outer ring segments each including an upper part which is removably attached to a lower part; and (b) an inner segmented ring removably attached onto an outer periphery surface of the grinding table so as to provide a narrow radial gap between said outer segmented ring and the inner segmented ring, wherein said inner ring segments each include a lower part removably attached onto the grinding table outer periphery, each said lower part having a plurality of upwardly oriented flow passages therein, and an upper part also removably attached to the outer periphery of the grinding table in an overlapping arrangement with the ring segment lower part, each said upper part having a plurality of upwardly oriented flow passages therein, the cross-sectional area of the flow passages in said ring segment upper parts being smaller than the cross-sectional area of the flow passages in said ring segment lower parts, whereby the ring segment upper parts can be removed and replaced independent of the ring segment lower parts.

2. A pulverizer assembly according to claim 1, wherein the flow passageways are oriented radially inwardly at an angle of 10°-20° relative to a vertical plane.

3. A pulverizer assembly according to claim 1, wherein the flow passageways are oriented forwardly at an angle of 40°-60° relative to a horizontal plane.

4. A pulverizer assembly according to claim 1, wherein the radial gap between the outer segmented ring and the rotatable inner segmented ring is 0.100-0.190 inches wide.

5. A pulverizer assembly for pulverizing particulate materials, including a housing, a grinding table mounted on a speed reducer in the housing and having annular air port openings provided between the grinding table and the housing, and roller means contacting the grinding table upper surface for pulverizing the particulate material thereon, wherein the improvement comprises:

(a) an outer segmented ring attached to the housing wall at a location opposite the grinding table, said outer ring segments each including an upper part which is removably attached to a lower part; and (b) an inner segmented ring removably attached onto an outer periphery surface of the grinding table, so as to provide a narrow radial gap between said outer segmented ring and the inner segmented ring, wherein said inner ring segments each include a lower part removably attached to a retainer ring which is attached rigidly to the grinding table outer periphery, each said lower part having a plurality of upwardly oriented flow passageways therein, and a ring segment upper part also removably attached to said retainer ring, each said flow passageway being oriented radially inwardly at an angle of 10°-20° relative to a vertical plane and oriented forwardly at an angle of 40°-60° relative to a horizontal plane, and wherein the inner ring upper parts have flow passage cross-sectional area which is smaller than that of the ring segment lower parts, whereby the ring segment upper parts can be removed and replaced independent of the ring segment lower parts.

6. A pulverizer assembly for pulverizing particulate materials, including a housing, a grinding table rotatably mounted in the housing and having annular air port openings provided between the table and the housing, and roller means contacting the grinding table upper surface for pulverizing the particulate material thereon, wherein the improvement comprises:

(a) an outer segmented ring attached to the housing wall at a location opposite the grinding table; and (b) an inner segmented ring removably attached onto an outer periphery surface of the grinding table, so as to provide a narrow radial gap between said outer segmented ring and the inner segmented ring, wherein said inner ring segments each include a lower part removably attached onto the grinding table outer periphery, each said lower part having a plurality of upwardly oriented flow passages therein, and a ring segment upper part also removably attached to the outer periphery of the grinding table in an overlapping arrangement with the ring segment lower part, each said upper part havina a plurality of upwardly oriented flow passages therein, and wherein the cross-sectional area of the flow passages in the inner ring segment upper parts is smaller than the cross-sectional area of the flow passages in the inner ring segment lower parts, and portions of the inner ring segments upper parts overlap flow passages in the inner ring segments lower parts, whereby the ring segment upper parts can be removed and replaced independent of the ring segment lower parts.

7. A pulverizer assembly according to claim 6, wherein the outer ring segments each include an upper part removably attached to a lower part of the outer ring segments, each said upper part having an upper surface which slopes radially outwardly and upwardly away from the radial gap upper end.

8. A pulverizer assembly according to claim 6, wherein said inner ring segments are bolted onto a segmented retainer ring, which retainer ring is attached rigidly onto the grinding ring outer periphery surface.

* * * * *